US008313693B2

(12) United States Patent
Winsell

(10) Patent No.: US 8,313,693 B2
(45) Date of Patent: Nov. 20, 2012

(54) SHAVING RAZOR MAINTENANCE SYSTEM

(76) Inventor: Charles D. Winsell, San Luis Obispo, CA (US)

( * ) Notice: Subject to any disclaimer, the term of this patent is extended or adjusted under 35 U.S.C. 154(b) by 54 days.

(21) Appl. No.: 12/906,591

(22) Filed: Oct. 18, 2010

(65) Prior Publication Data

US 2011/0138638 A1 Jun. 16, 2011

Related U.S. Application Data

(63) Continuation-in-part of application No. 12/072,018, filed on Feb. 22, 2008, now abandoned.

(51) Int. Cl.
*C23F 11/00* (2006.01)

(52) U.S. Cl. ..... 422/7; 422/28; 30/41; 30/538; 30/541

(58) Field of Classification Search ..... 422/292, 422/6, 7, 28; 206/352; 30/41, 538, 541
See application file for complete search history.

(56) References Cited

U.S. PATENT DOCUMENTS

| | | | | | |
|---|---|---|---|---|---|
| 1,981,853 | A | * | 11/1934 | Bruce | 206/208 |
| 5,468,496 | A | * | 11/1995 | Touzan et al. | 424/401 |
| 5,934,459 | A | | 8/1999 | Winsell | |
| 6,006,760 | A | * | 12/1999 | Benzinger | 132/286 |
| 2008/0006311 | A1 | * | 1/2008 | Brown et al. | 134/184 |
| 2009/0211100 | A1 | | 8/2009 | Winsell | |

OTHER PUBLICATIONS

U.S. Appl. No. 09/360,008, filed Jul. 1999, Winsell.

* cited by examiner

*Primary Examiner* — Sean E Conley
(74) *Attorney, Agent, or Firm* — Fish & Richardson P.C.

(57) ABSTRACT

A shaving razor maintenance system includes a razor container defining a reservoir bottom region and razor head supporting structure disposed to restrict razor head and blade portions from entering the reservoir bottom region, and a two-phase liquid including a first liquid including a first antimicrobial agent, and a non-corrosive second liquid. The first liquid is water-miscible and has a specific gravity relatively greater than the specific gravity of the second liquid. The first and second liquids are also immiscible, but, upon agitation, form a temporary, generally homogeneous emulsion. A method for maintaining a razor head and blade portion is also described.

9 Claims, 2 Drawing Sheets

SHAVING RAZOR MAINTENANCE SYSTEM

This application is a continuation-in-part of U.S. patent application Ser. No. 12/072,018, filed Feb. 22, 2008, now abandoned.

TECHNICAL BACKGROUND

This disclosure relates to razor blade protection, and more particularly to a system for maintaining razor blades between uses.

BACKGROUND

A major drawback to the use of razors in shaving is their short life span. After shaving, a razor is typically set aside on a shelf or bathtub surface, with some amount of water as well as residual debris, such as hair, remaining on the blade. Prolonged contact with water and/or air causes the razor blade to corrode (calcify, oxidize, etc.) and/or bond with adhered debris, effectively dulling the blade and reducing its performance and life span.

Applicant's U.S. Pat. No. 5,934,459, the entire contents of which are incorporated herein by reference, describes a "Non-Corrosive Flexible Storage Pouch with Reservoir Bottom for Storing a Shaving Razor," which ameliorated these drawbacks significantly by separating water and debris from a razor while immersing the razor in a non-corrosive liquid that preferably also includes conditioner. A razor is placed in a receptacle (pouch 10) that includes a reservoir at its bottom and a razor head supporting structure that supports the razor head above the reservoir. The receptacle contains a water-immiscible solution (preferably oil and conditioner) that is lighter than water (and likewise lighter than typical shaving debris), so that when the razor is placed in the receptacle, water (and debris) fall off the razor and settle into the reservoir where they are separated from the razor blade and solution. Once the accumulated water and debris reaches a certain level below the stored razor (ascertainment of which is preferably aided by the receptacle being transparent or having a transparent portion), the receptacle can be emptied and be refilled with new solution, for continued use.

Applicant's subsequent U.S. patent application Ser. No. 09/360,008, the entire contents of which are also incorporated herein by reference, describes an "Anti-Microbial Solution for Storing Razors," which addressed the possibility of localized portions of water adhering on the blade of a razor even though suspended in a non-corrosive liquid (as in the '459 patent) by including an anti-microbial additive (e.g., a mixture of two or more of isopropyl myristate, isopropylparaben, isobutylparaben, butylparaben, BHT, and triclosan) dissolved in the non-corrosive liquid (e.g., mineral oil).

SUMMARY

According to one aspect of the present disclosure, a method for maintaining a razor comprises: providing a liquid container defining a volume containing a first liquid and a second liquid, the first liquid being in a predetermined ratio to the total liquid, the first liquid being water-miscible, the second liquid having a specific gravity relatively lower than the specific gravity of the first liquid, and the first liquid and the second liquid being generally immiscible; providing a razor maintenance container defining a volume having a bottom reservoir region and an upper region, and containing razor head supporting structure extending at least into the bottom reservoir region, the upper bound of the upper region of the container being demarcated by a "fill line" indicator; agitating the liquid container to create a temporary, generally homogeneous emulsion of the first liquid and the second liquid; pouring the temporary, generally homogeneous emulsion of the first liquid and the second liquid into the volume of the razor maintenance container until the volume of emulsion reaches the "fill line" indicator; allowing the volume of the first liquid and the second liquid of the emulsion to separate, with the first liquid occupying the bottom reservoir region and the second liquid occupying at least the upper region, to the "fill line" indicator; placing a razor head and blade portion of a razor into the razor maintenance container, with the razor head resting upon the razor head supporting structure, in the second liquid in the upper region, above the first liquid; and allowing water and debris from the razor head and blade portion to be removed and fall into the bottom reservoir region, separated from the razor head and blade portion; the predetermined ratio of first liquid to total liquid in the liquid container being selected relative to respective volumes of the reservoir bottom region and the total volume of the razor container up to the "fill line" indicator, such that, when the generally homogeneous emulsion is poured into the razor maintenance container and allowed to separate, the interface between the first liquid and the second liquid in the razor maintenance container is generally below the top of the razor head supporting structure within the first liquid, thus spaced from contamination of a razor head and blade portion supported thereupon.

Preferred implementations of this aspect of the disclosure may contain one or more of the following additional features. The first liquid consists primarily of a water-miscible skin conditioning agent, e.g. glycerine. The first liquid further comprises a water-miscible anti-microbial agent The water-miscible anti-microbial agent comprises Dowicil® 200 preservative. The second liquid further comprises one or more of skin-friendly additives and anti-microbial agent. The second liquid comprises one or more of white mineral oil (petrolatum) and silicone oil. One or more of the first liquid and the second liquid contains suitably-soluble colorants to facilitate visual distinction between the first and second liquids. The method further comprises providing the first liquid in the liquid container in the predetermined ratio to total volume of the liquid container of about 1:4 to about 1:12.

According to another aspect of the present disclosure, a shaving razor maintenance system comprises: a razor container defining a reservoir bottom region and razor head supporting structure disposed to restrict razor head and blade portions from entering the reservoir bottom region; and a two-phase liquid comprising: a first liquid including a first anti-microbial agent; and a non-corrosive second liquid; the first liquid being water-miscible and having a specific gravity relatively greater than the specific gravity of the second liquid; the first liquid being immiscible with the second liquid; and the first liquid and the second liquid, upon agitation, forming a temporary, generally homogeneous emulsion.

Preferred implementations of this aspect of the disclosure may contain one or more of the following additional features. The first liquid and the second liquid have contrasting colors. The first liquid and the second liquid, upon agitation, form a temporary, generally homogeneous emulsion. The system further comprises a sealed, readily openable liquid container. The liquid container is partially filled with the two-phase liquid, leaving an air gap. The second liquid further comprises a second anti-microbial agent. The razor head supporting structure comprises one or more elements protruding upwardly at least into the reservoir bottom region. The razor container has a visually-demarcated "fill line" indicator. The ratio of the volume of the reservoir bottom region to the total volume of the razor maintenance container up to the "fill line" indicator is relatively greater than the ratio of the volume of the first liquid within the liquid container to the total volume of the two-phase liquid within the liquid container. 18. The ratio of the volume of the first liquid within the liquid container to the total volume of the two-phase liquid within the liquid container is between about 1:4 and about 1:12. The ratio of the volume of the bottom reservoir region to the total volume of the razor container up to the "fill line" indicator is generally between about 1:2 and about 1:5.

According to another aspect of the present disclosure, a razor container for use in a razor maintenance system comprises: a two-phase liquid comprising: a first liquid that is water-miscible and comprises an anti-microbial agent; and a non-corrosive second liquid having a specific gravity relatively lower than the specific gravity of the first liquid and being immiscible with the first liquid, the razor container defining a reservoir bottom region and razor head supporting structure restricting razor head and blade portions placed within the razor container from entering the reservoir bottom region.

Preferred implementations of this aspect of the disclosure may contain one or more of the following additional features. At least part of the razor container is transparent, and wherein the razor container includes a "fill line" indicator. The razor container is partly filled with the two-phase liquid, with the first liquid being below the "fill line" indicator. The first liquid and the second liquid have contrasting colors. The second liquid further comprises a second anti-microbial agent.

The present disclosure thus provides a shaving razor maintenance system that addresses concerns that a user using known systems, e.g. according to the '459 patent and/or the '008 application, may, notwithstanding a visual indication and product instructions, continue using a receptacle after the level of accumulated water and debris rises above the reservoir to reach the razor. The razor could then be subject to corrosion and/or contamination by bacteria harbored in the accumulated water.

The details of one or more implementation of the disclosure are set forth in the accompanying drawings and the description below. Other features, objects, and advantages of the disclosure will be apparent from the description and drawings, and from the claims.

DESCRIPTION OF DRAWINGS

Like reference symbols in the various drawings indicate like elements.

DETAILED DESCRIPTION

Figure 1:
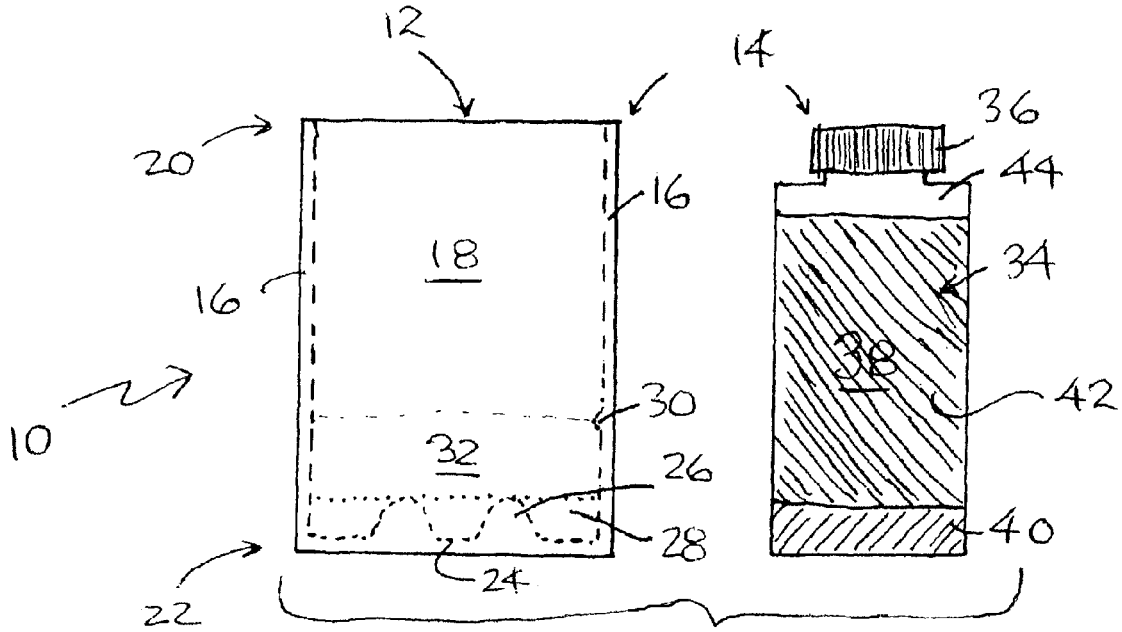
FIG. 1 is a front view of a shaving razor maintenance system of the disclosure consisting of a razor container and a sealed liquid container containing a two-phase liquid including a first liquid and a second liquid.
Figure 2:
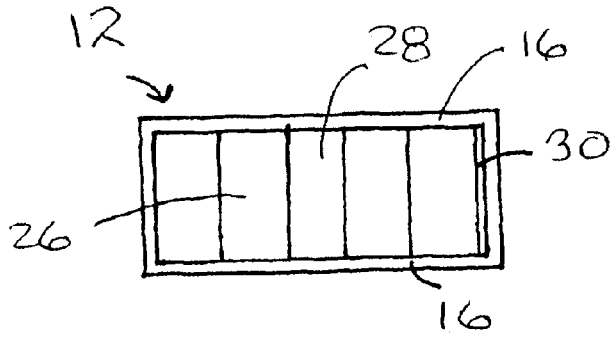
FIGS. 2 and 3 are a side view and a top view, respectively, of the razor container of FIG. 1.
Figure 3:
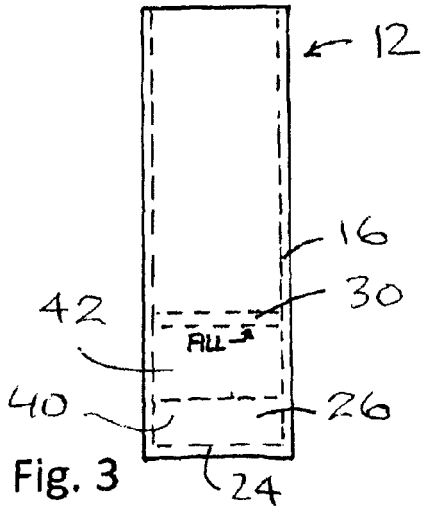
Figure 6:
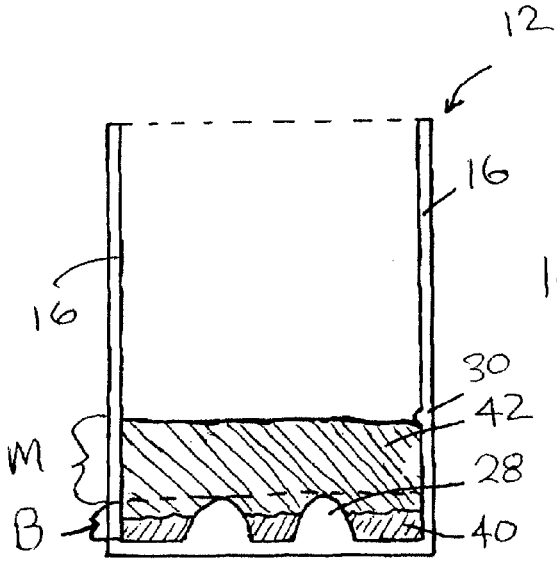
FIG. 6 is a similar section view of the razor container of FIGS. 2 and 3, after a period for separation, with the first liquid in a bottom reservoir region and the second liquid in a razor maintenance region generally thereabove.
Figure 7:
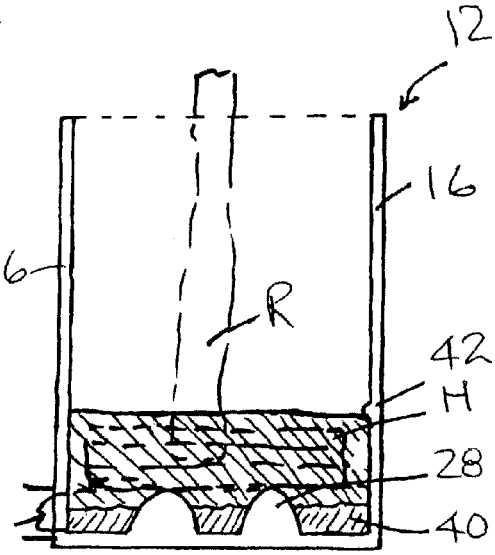
FIG. 7 is a front view of the razor container showing a razor (represented in dashed line) with the razor head and blade portion resting within the volume of the second liquid of the razor maintenance region, above the bottom reservoir region, supported by elevated razor head supporting structure, with the volume of first liquid in the bottom reservoir region, below the razor head, containing water and debris fallen from the razor head.

Referring to FIG. 1, a shaving razor maintenance system 10 of the disclosure includes a razor container 12 and a sealable liquid container 14. Referring also to FIGS. 2 and 3, the razor container 12, which preferably is formed of a stiff material, e.g. a polymeric material such as polycarbonate, has side walls 16 defining a razor container volume 18. The volume is open at the upper end 20, e.g. to receive at least a head and blade portion of a shaving razor, R (FIG. 7), as discussed more fully below, and the volume is closed at the lower end 22 by a bottom wall 24. An elevated razor head supporting structure 26 extends upwardly relative to the bottom wall within a bottom reservoir region 28, the reservoir region having a vertical extent or depth, B, as indicated in FIG. 7. The container 12 is marked on a side wall 16 with a visible "fill line" indicator 30, as shown, e.g., in FIGS. 3 and 6, demarcating a razor maintenance region 32 having a vertical extent, M, also as shown, e.g. in FIG. 7, extending generally above the bottom reservoir region 28. The ratio of the volume of the bottom reservoir region 28 to the total volume of the razor container 12 up to "fill line" indicator 30 is in the range, e.g., of about 1:2 to about 1:5.

Figure 4:
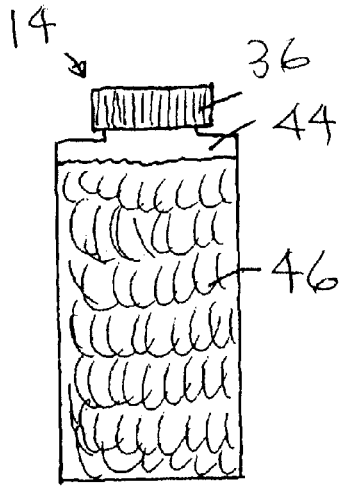
FIG. 4 is a front view of the liquid container of FIG. 1, with the first and second liquids in a temporary, generally homogeneous emulsion, after shaking.

Referring next to FIGS. 1 and 4, the shaving razor maintenance system 10 further includes the sealed liquid container 14, preferably in the form of a plastic bottle 34 with a removable, screw-on plastic cap 36. The liquid container 14 defines a sealed volume 38, containing a two-phase liquid consisting of a first liquid 40 and a second liquid 42. The first liquid 40 is water-miscible and may, for example, consist primarily of a water-miscible skin conditioning agent, e.g. glycerine. The second liquid 42 has a specific gravity relatively lower than the specific gravity of the first liquid 40. The first liquid 40 and the second liquid 42 are generally immiscible. For example, the second liquid 42 may consist of white mineral oil (petrolatum) or a suitable silicone oil. One or both of the first liquid 23 and second liquid 24 may optionally include contrasting, suitably-soluble colorants to facilitate visual distinction between the liquids in the razor container.

The liquid container 14 is partially filled with predetermined ratio of the volume of the first liquid 40 to the total volume of liquid 46, leaving an air gap 44. The predetermined ratio of the volume of first liquid 40 to the total volume of liquid 46 preferably is relatively small, e.g., 1:4 to 1:12.

Upon manual shaking of the liquid container 14, aided by enhanced turbulence created by provision of air gap 44, the first liquid 40 and the second liquid 42 contained therein readily form a temporary, generally homogeneous emulsion 48, e.g. as shown in FIG. 4, the predetermined ratio of first liquid to total liquid in the liquid container being selected relative to respective volumes of the reservoir bottom region and the total volume of the razor container up to the "fill line" indicator, such that, when the generally homogeneous emulsion is poured into the razor maintenance container and allowed to separate, the interface between the first liquid and the second liquid in the razor maintenance container is generally below the top of the razor head supporting structure and thus spaced from contamination of a razor head and blade portion supported thereon. This ensures that the aforementioned ratio of first liquid 40 to total liquid 46 is attained throughout the liquid in the liquid container 14 on a relatively fine scale.

Figure 5:
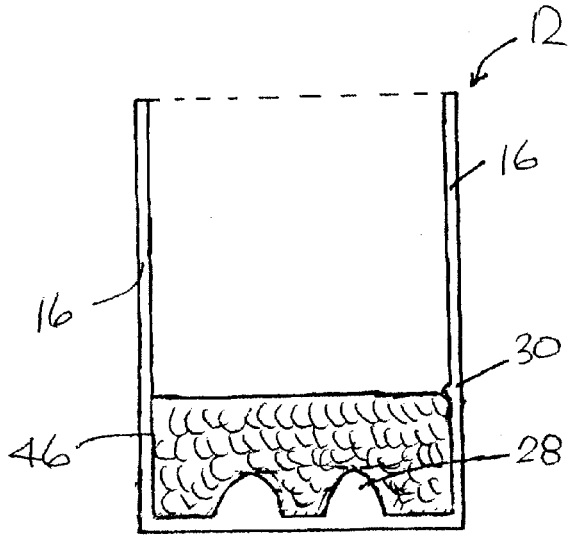
FIG. 5 is a sectional view of the razor container of FIGS. 2 and 3, filled to a "fill line" indicator with the two-phase liquid emulsion, immediately after filling to the "fill line" indicator with the shaken liquid.

Referring to FIG. 5, the user then pours the temporary, generally homogeneous emulsion 46 into an empty razor container 20, until the liquid 46 reaches the visible "fill line" indicator 30. The emulsion dissipates relatively rapidly as the first and second liquids separate, and, referring to FIG. 6, after a period of time, the liquid in the razor container settles back into two phases (resuming the aforementioned ratio on a gross scale), with the first liquid 40 residing entirely within the reservoir bottom region 28, and the second liquid 42 resting upon and being entirely above the first liquid 40, although the second liquid 42 typically extends partly within the top of reservoir bottom region 28, as seen in the figures.

The first liquid 40 may include a water-miscible anti-microbial agent, e.g. such as Dowicil® 200 preservative, an anti-microbial preservative having cis isomer 1-(3-chloroallyl)-3,5,7-triaza-1-azonia adamantine chloride as its active ingredient, preferably in a relatively high concentration, e.g. such as 0.1%, so that when run-off water accumulates in the first liquid 40 contained in the bottom reservoir region 28, as explained below, the anti-microbial agent is not diluted below a minimum level of desired efficacy. The second liquid 42 may also include such an antimicrobial agent, e.g., as described in Applicant's U.S. patent application Ser. No. 09/360,008, mentioned above.

Referring to FIG. 7, the razor user can then place a shaving razor, R, into the razor container 20, with the handle end up and with the razor head and blade portion, H, down, resting upon the elevated razor head supporting structure 26. Water and debris clinging to the razor will then tend to fall off of the razor head, and, due to its relatively greater density, e.g., as compared to the second liquid 42, settling to the bottom of the bottom reservoir region 28. Since the first liquid 40 at the bottom of reservoir bottom region 28 is water-miscible, settling water will mix with and become incorporated into first liquid 40. Also, since the first liquid 40 includes an anti-microbial agent, even if a user allows the first liquid 40 and residue to accumulate above the top of elevated razor head supporting structure 26, so as to come into contact with the razor head and blade portion, the razor will not be exposed to bacteria.

While the invention is susceptible to various modifications and alternative forms, specific examples have been shown in the drawings and as described in detail. It should be understood, however, that the invention is not limited to the particular forms disclosed. Rather, the invention is intended to cover all modifications and alternatives falling within the spirit and scope of the claims and their equivalents.

What is claimed is:

1. A method for maintaining a razor, comprising: providing a liquid container defining a volume containing a first liquid and a second liquid, the first liquid volume being in a predetermined ratio to total volume, the first liquid being water-miscible, the second liquid having a specific gravity relatively lower than the specific gravity of the first liquid, and the first liquid and the second liquid being generally immiscible; providing a razor maintenance container defining a volume having a bottom reservoir region and an upper region, and containing razor head supporting structure extending at least into the bottom reservoir region, the upper bound of the upper region of the container being demarcated by a "fill line" indicator; agitating the liquid container to create a temporary, generally homogeneous emulsion of the first liquid and the second liquid; pouring the temporary, generally homogeneous emulsion of the first liquid and the second liquid into the volume of the razor maintenance container until the volume of emulsion reaches the "fill line" indicator; allowing the volumes of the first liquid and the second liquid of the emulsion to separate, with the first liquid occupying the bottom reservoir region and the second liquid occupying at least the upper region, to the "fill line" indicator; placing a razor head and blade portion of a razor into the razor maintenance container, with the razor head in the upper region, resting upon the razor head supporting structure, in the second liquid in the upper region, above the first liquid; and allowing water and debris from the razor head and blade portion to be removed and fall into the bottom reservoir region, separated from the razor head and blade portion; the predetermined ratio of first liquid to total liquid in the liquid container being selected relative to respective volumes of the reservoir bottom region and the total volume of the razor container up to the "fill line" indicator, such that, when the generally homogeneous emulsion is poured into the razor maintenance container and allowed to separate, the interface between the first liquid and the second liquid in the razor maintenance container is generally below the top of the razor head supporting structure, with the first liquid thus spaced from contamination of a razor head and blade portion supported thereon.

2. The method of claim 1, wherein the first liquid consists primarily of a water-miscible skin conditioning agent.

3. The method of claim 2, wherein the water-miscible skin conditioning agent comprises glycerine.

4. The method of claim 2, wherein the first liquid further comprises a water-miscible anti-microbial agent.

5. The method of claim 4, wherein the water-miscible anti-microbial agent comprises a preservative having cis isomer 1-(3-chloroallyl)-3,5,7-triaza-1-azonia adamantine chloride as its active ingredient.

6. The method of claim 1, wherein the second liquid further comprises one or more of skin-friendly additives and anti-microbial agent.

7. The method of claim 1, wherein the second liquid comprises one or more of white mineral oil (petrolatum) and silicone oil.

8. The method of claim 1, wherein one or more of the first liquid and the second liquid contains suitably-soluble colorants to facilitate visual distinction between the first and second liquids.

9. The method of claim 1, further comprising providing the first liquid in the liquid container in the predetermined ratio to total volume of the liquid container of about 1:4 to about 1:12.

* * * * *